US009771673B2

(12) United States Patent
Ikenaka et al.

(10) Patent No.: US 9,771,673 B2
(45) Date of Patent: Sep. 26, 2017

(54) METHOD FOR KNITTING SHOE UPPER

(71) Applicant: Shima Seiki Mfg., Ltd., Wakayama-shi, Wakayama (JP)

(72) Inventors: Masamitsu Ikenaka, Wakayama (JP); Kenta Terai, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 105 days.

(21) Appl. No.: 14/767,966

(22) PCT Filed: Dec. 18, 2013

(86) PCT No.: PCT/JP2013/083902
§ 371 (c)(1),
(2) Date: Aug. 14, 2015

(87) PCT Pub. No.: WO2014/129068
PCT Pub. Date: Aug. 28, 2014

(65) Prior Publication Data

US 2015/0374062 A1 Dec. 31, 2015

(30) Foreign Application Priority Data

Feb. 25, 2013 (JP) ..... 2013-035092

(51) Int. Cl.
*D04B 1/22* (2006.01)
*A43B 1/04* (2006.01)
(Continued)

(52) U.S. Cl.
CPC ..... *D04B 1/22* (2013.01); *A43B 1/04* (2013.01); *A43B 23/0245* (2013.01);
(Continued)

(58) Field of Classification Search
CPC ..... D04B 1/108; D04B 1/123; D04B 1/22; D04B 1/24
See application file for complete search history.

(56) References Cited

U.S. PATENT DOCUMENTS 2,962,885 A 12/1960 Knohl
5,299,435 A * 4/1994 Whalley ..... D04B 1/123 66/190
(Continued)

FOREIGN PATENT DOCUMENTS

EP 2 147 994 A1 1/2010
EP 2 805 638 A1 11/2014
(Continued)

OTHER PUBLICATIONS

Extended European Search Report issued in Application No. 13875782.8, dated Aug. 10, 2016.
(Continued)

*Primary Examiner* — Danny Worrell
(74) *Attorney, Agent, or Firm* — Rothwell, Figg, Ernst & Manbeck, P.C.

(57) ABSTRACT

There is provided a method for knitting a shoe upper that can allow the reinforcement degree of the shoe upper to be changed with a small number of yarn feeders.
A method for knitting a shoe upper (1) including an instep cover section (3) that covers a portion on an instep side of a wearer and a sole cover section (2) that covers a sole of the wearer is provided. The instep cover section (3) and the sole cover section (2) are three-dimensionally knitted in a seamless manner; and in the knitting process, at least one base section (10) configuring a part of the shoe upper (1) is knitted using a base knitting yarn containing a non-thermal adhesive yarn and a thermal adhesive yarn, and a reinforcement knitting yarn containing a thermal adhesive yarn is interwoven in the base section (10) to reinforce the base
(Continued)

section (10). In this case, the number of knitting with the reinforcement knitting yarn with respect to the base section (10) is changed.

5 Claims, 3 Drawing Sheets

(51) Int. Cl.
*A43B 23/02* (2006.01)
*D04B 1/10* (2006.01)
*A43D 11/01* (2006.01)
*D04B 1/12* (2006.01)

(52) U.S. Cl.
CPC ..... *A43D 11/01* (2013.01); *D04B 1/108* (2013.01); *D04B 1/123* (2013.01); *D10B 2403/0332* (2013.01); *D10B 2501/043* (2013.01)

(56) References Cited

U.S. PATENT DOCUMENTS

2008/0110048 A1* 5/2008 Dua ..... A43B 1/04 36/45
2010/0154256 A1 6/2010 Dua
2010/0269372 A1* 10/2010 Dua ..... A43B 1/04 36/47
2010/0281631 A1* 11/2010 Dua ..... A43B 1/04 12/146 C
2012/0285043 A1* 11/2012 Dua ..... A43B 1/04 36/84
2014/0150295 A1* 6/2014 Dua ..... A43B 1/04 36/84
2014/0245643 A1* 9/2014 Huffa ..... A43B 1/04 36/9 R

FOREIGN PATENT DOCUMENTS

EP 2 875 745 A1 5/2015
JP 2012-512698 A 6/2012
WO 9100936 A1 1/1991
WO 2012/125473 A2 9/2012
WO 2013/108506 A1 7/2013
WO 2014/013790 A1 1/2014

OTHER PUBLICATIONS

International Search Report cited in PCT/JP2013/083902 dated Mar. 25, 2014, 1 page.

* cited by examiner

METHOD FOR KNITTING SHOE UPPER

CROSS REFERENCE TO RELATED APPLICATION

This application is a 35 U.S.C. 371 National Phase Entry Application from PCT/JP2013/083902, filed Dec. 18, 2013, which claims the benefit of Japanese Patent Application No. 2013-035092 filed on Feb. 25, 2013, the disclosure of which is incorporated herein in its entirety by reference.

TECHNICAL FIELD

The present invention relates to a method for knitting a shoe upper.

BACKGROUND ART

A shoe includes a shoe upper configured by a sole cover section that covers a sole of a wearer, and an instep cover section that covers a portion on an instep side of the wearer. In outdoor shoes, an outer sole made of synthetic resin and the like is attached to the sole cover section of the shoe upper. In recent years, attempts have been made to form the instep cover section, of the instep cover section and the sole cover section configuring the shoe upper, with one knitted fabric to manufacture the shoe with high productivity. For example, in Patent Document 1, the instep cover section in a planar developed state is manufactured with one knitted fabric, and such instep cover section is joined to the outer sole made of synthetic resin and the like along with the sole cover section to complete the shoe.

The shoe upper is configured with a knitting yarn containing a thermal adhesive yarn and a non-thermal adhesive yarn, and is molded by thermal treatment after the knitting. As a result, the shape of the stitches configuring the shoe upper, that is, the shape of the shoe upper is less likely to lose shape. Such shoe upper has a few areas where strength is particularly desired. For example, in Patent Document 1, an inlay knitting yarn (reinforcement knitting yarn) is interwoven at a portion from the vicinity of an eyelet for passing a shoelace to a side surface of the instep cover section so that the relevant portion is reinforced.

PRIOR ART DOCUMENT

Patent Document

[Patent Document 1] International Patent Publication No. 2012/125473

DISCLOSURE OF THE INVENTION

Problems to be Solved by the Invention

When reinforcing a part of the shoe upper using the inlay knitting yarn, a high-tension yarn is generally used for the inlay knitting yarn. A pulling force that acts on the shoe upper is received by the high-tension inlay knitting yarn to suppress the stretching of the shoe upper. However, in such reinforcement method, a plurality of inlay knitting yarns having different tensions needs to be used when changing the reinforcement degree of each reinforcing area in the shoe upper which has a plurality of reinforcement areas, or when partially changing the reinforcement degree of one reinforcement area. Since the number of yarn feeders that can be arranged in a flat knitting machine is limited, when knitting a colorful shoe upper, for example, the number of yarn feeders for reinforcement may become insufficient if the number of yarn feeders for color is increased, and the number of yarn feeders for color may become insufficient if the number of yarn feeders for reinforcement is increased.

The present invention has been made in light of the above circumstances and an object of the present invention is to provide a method for knitting a shoe upper that can allow the reinforcement degree of the shoe upper to be changed with a small number of yarn feeders.

Means for Solving the Problems

An aspect of the present invention relates to a method for knitting a shoe upper for knitting a shoe upper including an instep cover section that covers a portion on an instep side of a wearer and a sole cover section that covers a sole of the wearer. In the method for knitting the shoe upper of the present invention, the instep cover section and the sole cover section are three-dimensionally knitted in a seamless manner; and in the knitting process, at least one base section configuring a part of the shoe upper is knitted using a base knitting yarn containing a non-thermal adhesive yarn and a thermal adhesive yarn, and a reinforcement knitting yarn containing a thermal adhesive yarn is interwoven in the base section to carry out at least one of a reinforcement operation I and a reinforcement operation II, described below, for reinforcing the base section.

[Reinforcement operation I] reinforcement operation of partially changing a reinforcement degree of the base section by making the number of knitting with the reinforcement knitting yarn with respect to at least some stitch rows, of a plurality of stitch rows configuring the base section, different from the number of knitting with the reinforcement knitting yarn with respect to the other stitch rows.

[Reinforcement operation II] reinforcement operation of, when knitting a plurality of base sections in the shoe upper, changing a reinforcement degree of each base section by making the number of knitting with the reinforcement knitting yarn with respect to some base sections different from the number of knitting with the reinforcement knitting yarn with respect to the other base sections.

According to one aspect of the method for knitting the shoe upper of the present invention, the base section, in which the reinforcement knitting yarn is interwoven, is knitted across the instep cover section and the sole cover section.

According to another aspect of the method for knitting the shoe upper of the present invention, the reinforcement knitting yarn contains a non-thermal adhesive yarn.

According to another aspect of the method for knitting the shoe upper according to the present invention, the reinforcement knitting yarn is interwoven in the base section by tuck knitting. For example, when carrying out the reinforcement operation I using the tuck knitting, the tuck knitting for two courses (number of knitting=2) of reciprocating the yarn feeder with respect to the $n^{th}$ stitch row of the base section is carried out, and then the tuck knitting for three courses (number of knitting=3) is carried out with respect to the $n+1^{th}$ stitch row.

According to another aspect of the method for knitting the shoe upper of the present invention, the reinforcement knitting yarn is interwoven in the base section by inlay knitting. For example, when carrying out the reinforcement operation I using the inlay knitting, the inlay knitting for two courses (number of knitting=2) is carried out with respect to the $n^{th}$ stitch row of the base section, and then the inlay knitting for three courses (number of knitting=3) is carried out with respect to the $n+1^{th}$ stitch row.

The tuck knitting and the inlay knitting can be carried out in combination. For example, both the tuck knitting and the inlay knitting may be carried out with respect to a specific stitch row configuring the base section.

Effects of the Invention

According to the method for knitting the shoe upper of the present invention, the reinforcement degree of the shoe upper can be changed with a small number of yarn feeders. This is because the reinforcement degree of the base section can be changed by the number of knitting of interweaving the reinforcement knitting yarn in the base section, whereby the number of reinforcement knitting yarns corresponding to the number of changes in the reinforcement degree does not need to be prepared. For example, if the shoe upper includes four base sections and the reinforcement degree of each base section is to be changed, the number of reinforcement knitting yarns to be prepared (i.e., number of yarn feeders to be prepared for reinforcement) can be three or less, or ultimately even one.

In the method for knitting the shoe upper of the present invention, the base knitting yarn for configuring the base section and the reinforcement knitting yarn for reinforcing the base section both contain the thermal adhesive yarn, which greatly contributes to changing the reinforcement degree of the base section. When the shoe upper knitted through the method for knitting the shoe upper according to the present invention is subjected to thermal treatment, the thermal adhesive yarn contained in the base knitting yarn melts, so that the shape and the arrangement state of the stitches of the base section formed with the non-thermal adhesive yarn contained in the base knitting yarn are fixed. At the same time, the thermal adhesive yarn contained in the reinforcement knitting yarn also melts, so that the shape and the arrangement state of the stitches of the base section are reinforced. In this case, the amount of thermal adhesive yarn that melts when the thermal treatment is carried out increases and the reinforcement effect increases by increasing the number of knitting with the reinforcement knitting yarn. That is, higher reinforcement effect can be obtained by increasing the number of knitting with the reinforcement knitting yarn containing the thermal adhesive yarn than by simply increasing the number of knitting with the reinforcement knitting yarn that does not contain the thermal adhesive yarn.

As opposed to the method for knitting the shoe upper of the present invention, if the reinforcement knitting yarn does not contain the thermal adhesive yarn, and the proportion of the thermal adhesive yarn in the base knitting yarn is increased without changing the thickness of the base knitting yarn (i.e., proportion of the non-thermal adhesive yarn is reduced), the stitches of the base section formed with the non-thermal adhesive yarn become narrow and the reinforcement of the base section lowers. If the absolute amount of the thermal adhesive yarn in the base knitting yarn is increased, the base knitting yarn becomes thick and the knitting of the base section may become difficult to carry out. Such problems do not arise in the method for knitting the shoe upper of the present invention in which the reinforcement knitting yarn contains the thermal adhesive yarn.

According to the method for knitting the shoe upper of the present invention in which the base section is knitted across the instep cover section and the sole cover section, the pulling force that acts on the base section can be dispersed, and the shape and the arrangement of the stitches of the base section are less likely to lose shape.

According to the method for knitting the shoe upper of the present invention in which the reinforcement knitting yarn contains the non-thermal adhesive yarn, the pulling force that acts on the base section can be received by the non-thermal adhesive yarn of the reinforcement knitting yarn, and the shape and the arrangement of the stitches of the base section are less likely to lose shape.

MODE FOR CARRYING OUT THE INVENTION

Hereinafter, an embodiment of a method for knitting a shoe upper of the present invention will be described based on the drawings. A two-bed flat knitting machine including at least a pair of a front and a back needle bed and in which stitches can be transferred between the front and back needle beds is used in the method for knitting the shoe upper. Of course, the flat knitting machine to be used is not limited to the two-bed flat knitting machine, and may be, for example, a four-bed flat knitting machine.

First Embodiment

<<Overall Configuration>>

Figure 1:
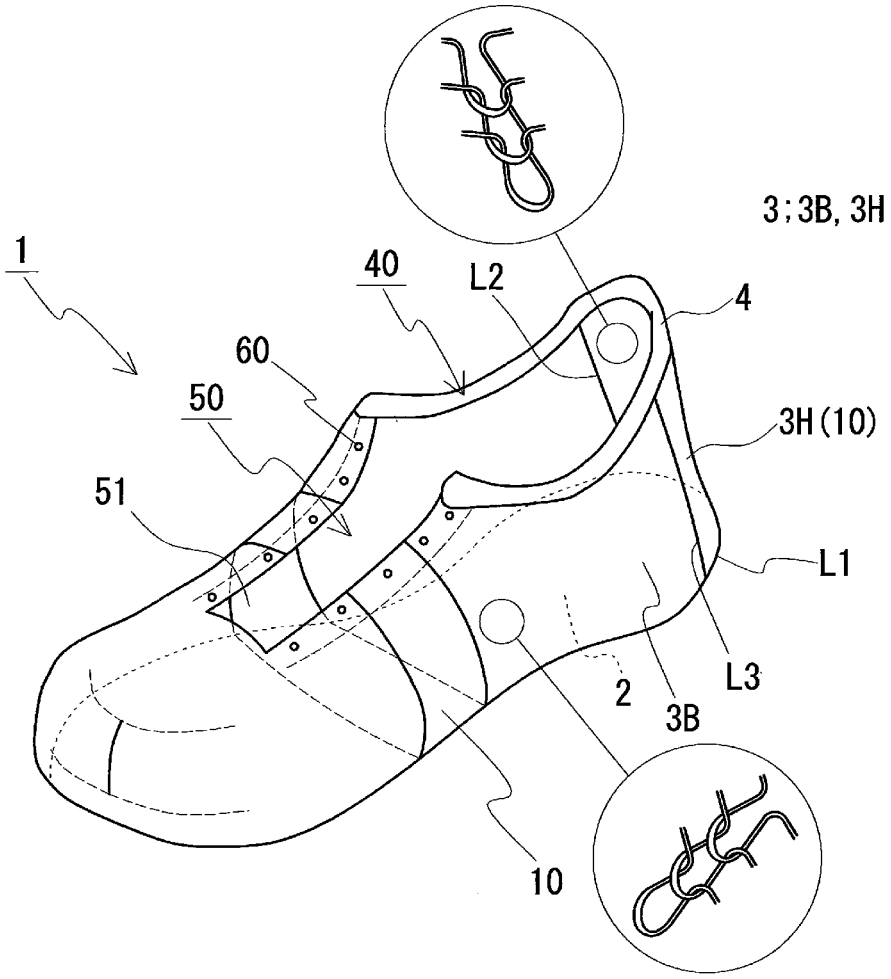
FIG. 1 is a schematic top perspective view of a shoe upper shown in a first embodiment.

A shoe upper 1 of the present embodiment shown in FIG. 1 includes an instep cover section 3 that covers a portion on an instep side of a wearer, and a sole cover section 2 that covers a portion of a sole of the wearer. The shoe upper 1 differs from the conventional shoe upper in the following two points.

[1] The instep cover section 3 and the sole cover section 2 are three-dimensionally knitted in a seamless manner.

[2] A base section 10 reinforced by interweaving a reinforcement knitting yarn containing a thermal adhesive yarn exists in plurals in the shoe upper 1, where a reinforcement degree of each base section 10 is different.

The shoe upper 1 of the first embodiment is three-dimensionally knitted in a seamless manner because a heel cover portion 3H extending from an upper end to a lower end of the instep cover section 3 is formed at a position corresponding to a region from an Achilles tendon to the heel of the wearer in the instep cover section 3 of the shoe upper 1. A portion excluding the heel cover portion 3H is a body portion 3B. The heel cover portion 3H has a knitting width of a predetermined width, for example, three or more stitches, and the direction of the stitches of a knitting structure configuring the heel cover portion 3H is directed in a height direction (downward) of the shoe upper (see circled enlarged view on upper side).

At an edge L1, which is a boundary of the heel cover portion 3H and the sole cover section 2, a starting end in a wale direction of the sole cover section 2 is connected in continuation to a terminating end in a wale direction of the heel cover portion 3H. At edges L2, L3, which are boundaries of the heel cover portion 3H and the body portion 3B, a starting end in the wale direction of the body portion 3B is connected in continuation to an end (side end) in a knitting width direction of the heel cover portion 3H. Thus, the direction of the stitches of the heel cover portion 3H is directed in the height direction of the shoe upper 1, whereas the direction of the stitches of the body portion 3B is directed in a length direction (forward) of the shoe upper 1 (see circled enlarged view on lower side). The end in the knitting width direction of the heel cover portion 3H and the end in the wale direction of the body portion 3B are connected at the positions of the edges L2, L3 to obtain a state in which the heel cover portion 3H and the body portion 3B are three-dimensionally connected.

A slit 50 extending from an insert section 4, to be described later, toward a toe is formed in the instep side portion of the body portion 3B (i.e., instep side portion of the instep cover section 3), so that a foot can be easily inserted from a foot insertion opening 40. An eyelet hole 60 for attaching an eyelet for passing a shoelace is formed at positions sandwiching the slit 50 in the body portion 3B.

In addition, the insert section 4 is arranged in the shoe upper 1 of the present embodiment. The insert section 4 is a knitting structure arranged at an edge portion in a vicinity of the foot insertion opening 40 of the shoe upper 1, that is, an upper end edge portion of the instep cover section 2, and is connected to the body portion 3B and the heel cover portion 3H in a seamless manner. The insert section 4 mainly has a function of stabilizing the contour shape of the edge portion of the instep cover section 3 in the vicinity of the foot insertion opening 40, and as a result, the shoe upper 1 in which the foot can be easily inserted from the foot insertion opening 40 can be obtained. The direction of the stitches of the insert section 4 reflects the knitting processes, to be described later, and is directed in the same direction as the stitches of the heel cover portion 3H.

<<Base Section>>

In the present embodiment, the base section 10 in which the reinforcement knitting yarn is interwoven is provided in two areas. The first area is the heel cover portion 3H. The heel cover portion 3H is arranged in an area that serves as a heel counter for fixing the position of an ankle in the shoe upper 1, and is desired to have a strength that does not easily bend. The second area is a portion that surrounds a portion slightly heel side of the root of the toe of the wearer. This portion serves to fix the shoe upper 1 to the foot so that the foot of the wearer does not shift forward or backward inside the shoe upper 1, where the shoe upper 1 cannot be fixed to the foot if the relevant portion is stretched. The base section 10 is reinforced using the reinforcement knitting yarn containing the thermal adhesive yarn so that the base section 10 in the two areas does not easily stretch. The details on the manner of reinforcement will be described later.

<<Method for Knitting Shoe Upper>>

Figure 2:
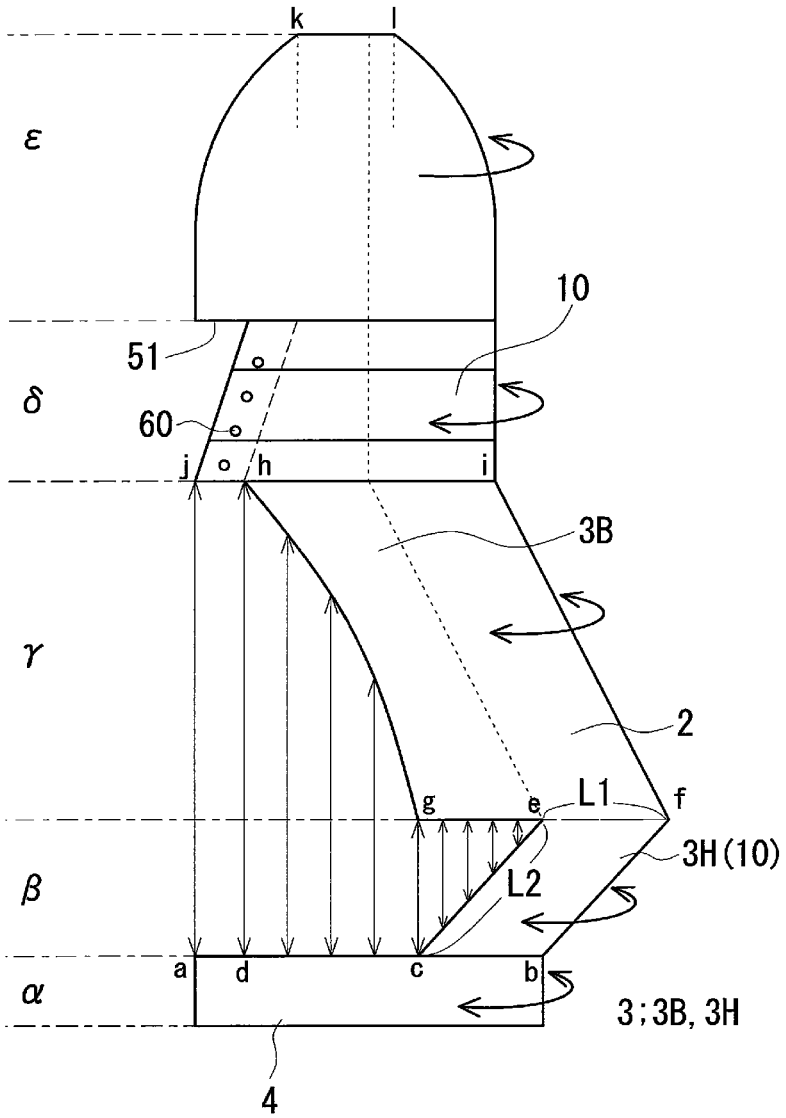
FIG. 2 is a knitting process image view schematically showing a knitting process of the shoe upper of the first embodiment.

The shoe upper 1 can be manufactured by knitting the right side portion of the shoe upper 1 with one needle bed of the flat knitting machine and the left side portion with the other needle bed. FIG. 2 is a knitting image view schematically showing a knitting procedure of the right side portion of the shoe upper 1. The left side portion of the shoe upper 1 may be assumed as being arranged on the far side in the plane of drawing in FIG. 2, and the right side portion and the left side portion of the shoe upper 1 are connected on the right side in the plane of drawing. The left side portion of the shoe upper 1 is knitted through knitting similar to the right side portion, and thus the description thereof will be omitted. Needless to say, the shape of the feet is asymmetric, and thus the knitting width and the like of the right side portion and the left side portion of the shoe upper 1 are preferably changed in accordance with the shape of the foot.

In FIG. 2, the knitting advances from the lower side toward the upper side. The shoe upper 1 in the present embodiment is knitted by being divided into five regions of an insert section region α, a heel region β, a main body back part region γ, a main body central region δ, and a main body front part region ϵ. The region α corresponds to the insert section 4, the region β corresponds to the heel cover portion 3H (base section 10), and the regions γ to ϵ correspond to the body portion 3B and the sole cover section 2. Each region α to ϵ is basically knitted by C-shaped knitting or tubular knitting (two-headed arrow indicates the C-shaped knitting, and one-headed arrow indicates the tubular knitting). A short dotted line in FIG. 2 indicates the boundary of the instep cover section 3 and the sole cover section 2, the long dotted line indicates the portion where the narrowing stitch is formed, the chain dashed line indicates the boundary of the regions α to ϵ, and lower case alphabets a to 1 are given to the positions that are important in the knitting in FIG. 2.

[Knitting of Insert Section Region α]

In the knitting shown in FIG. 2, the C-shaped knitting having the right side as the turn-back position is first carried out to knit the insert section 4. That is, the insert section 4 held on the front and back needle beds is not connected at the position on the left side in the plane of drawing, and a slit 50 is formed from such unconnected portion (see FIG. 1).

[Knitting of Heel Region β]

A plurality of stitch rows is knitted following in a wale direction of some stitches of the insert section 4. Such stitch rows configure the heel cover portion 3H. In this case, knitting of the stitch row of the heel cover portion 3H for one to three tiers, and transfer of the knitted stitch row toward a side (right side) away from the insert section 4 are repeated. When knitting a new stitch row in continuation to the wale direction of the stitch row in which the transfer is carried out, a pickup stitch is formed at the end in the knitting width direction of the new stitch row. That is, the pickup stitches are lined on the line c-e in the figure. When such knitting is repeated and the heel cover portion 3H is completed, the stitches of a-c, the pickup stitches of c-e, and the stitches of e-f are held on the knitting needles of the needle beds. The stitches of a-c are the stitches at the terminating end in the wale direction of the insert section 4, the pickup stitches of c-e are the pickup stitches at the end in the knitting width direction of the heel cover portion 3H (corresponds to edge L2 in FIG. 1), and the stitches of e-f are the stitches at the terminating end in the wale direction of the heel cover portion 3H (corresponds to the right side portion of the edge L1 of FIG. 1).

The heel cover portion 3H may be knitted so that the knitting width becomes wider from the upper end toward the lower end of the instep cover section 3. In other words, the heel cover portion 3H is knitted while increasing the knitting width through split knitting and the like so that the width of e-f becomes wider than the width of c-b. The portion on the sole cover section 2 side of the heel cover portion 3H shown in FIG. 1 thus bulges out toward the back side of the shoe upper 1, and the shoe upper 1 that lies along the shape from the Achilles tendon to the heel of the wearer can be obtained.

In the shoe upper 1 of the present embodiment, the base section 10 is reinforced by interweaving the reinforcement knitting yarn in the heel cover portion 3H (hereinafter referred to as base section 10). In reinforcement, the base section 10 is knitted using a base knitting yarn containing the thermal adhesive yarn and the non-thermal adhesive yarn, and the base section 10 is reinforced by interweaving the reinforcement knitting yarn containing the thermal adhesive yarn in the base section 10. The reinforcement knitting yarn may contain the non-thermal adhesive yarn.

The thermal adhesive yarn may be a yarn that has a core-sheath structure of including a core part and a sheath part that covers the outer periphery of the core part, a softening temperature of the sheath part being lower than a softening temperature of the core part. The non-thermal adhesive yarn may be a yarn that does not soften at the softening temperature of the thermal adhesive yarn, for example, a yarn that is less likely to stretch such as polyester yarn and the like, and an elastic yarn such as a polyurethane yarn. The thermal adhesive yarn and the non-thermal adhesive yarn may be appropriately combined to obtain the base knitting yarn and the reinforcement knitting yarn. The thickness and the number of the thermal adhesive yarn and the non-thermal adhesive yarn also can be appropriately selected.

When reinforcing the base section 10 using the reinforcement knitting yarn containing at least the thermal adhesive yarn, tuck knitting or inlay knitting is representatively carried out to interweave the reinforcement knitting yarn in the base section 10.

In the reinforcement using the tuck knitting, the reinforcement knitting yarn is tucked to at least some stitches (may be all stitches) of the base section 10 held on the knitting needles of the needle beds. For example, after knitting the base section 10 made of only the base knitting yarn, the tuck knitting is carried out on the base section 10. Alternatively, after knitting the base section 10 in which the reinforcement knitting yarn is interwoven in the base knitting yarn by plating knitting, the tuck knitting may be further carried out using only the reinforcement knitting yarn on the base section 10. The plating knitting is a known knitting method of simultaneously moving the yarn feeder of the base knitting yarn and the yarn feeder of the reinforcement knitting yarn to knit the knitted fabric. Reference is to be made to International Patent Publication No. 2008/139710, for example, for the plating knitting. The number of knitting (number of courses) with the reinforcement knitting yarn with respect to the stitch rows configuring the base section 10 may be changed in order to change the reinforcement degree of the base section 10. If the tuck knitting is carried out for two courses, the reinforcement degree of the base section 10 increases by the amount the number of courses is increased, compared to when the tuck knitting for one course is carried out with respect to the stitch row.

In the reinforcement using the inlay knitting, the reinforcement knitting yarn is sandwiched between the stitches. For example, after knitting the base section 10 made of only the base knitting yarn, the inlay knitting is carried out on the base section 10. Alternatively, after knitting the base section 10 in which the reinforcement knitting yarn is interwoven in the base knitting yarn by the plating knitting, the inlay knitting may be further carried out using only the reinforcement knitting yarn on the base section 10. For reference, one example of inlay knitting will be described in accordance with FIG. 3. "S+number" in FIG. 3 indicates the number of the knitting process, "FB" indicates the front needle bed, "BB" indicates the back needle bed, and "A to P" indicate the positions of the knitting needles. The procedure of FIG. 3 is merely an example, and such procedure is not the only case.

Figure 3:
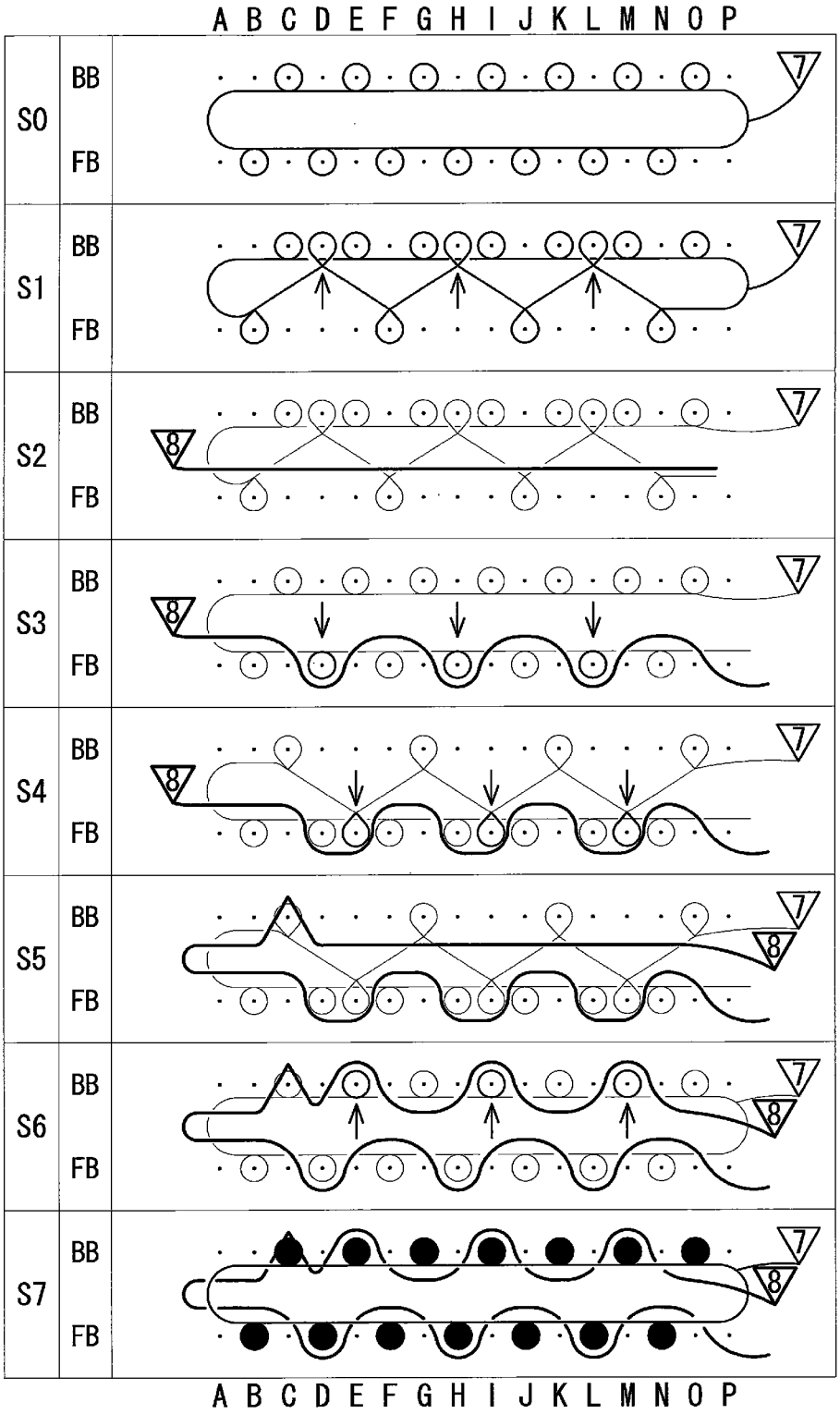
FIG. 3 is a knitting process view of when an inlay knitting is carried out to knit a reinforcement section of the shoe upper.

In S0 of FIG. 3, a state in which the stitch row of the base section 10 knitted with the base knitting yarn fed from a yarn feeder 7 is held is shown. The base section 10 may be formed by feeding the thermal adhesive yarn and the non-thermal adhesive yarn in an aligned state from one yarn feeder, or may be formed by plating knitting of feeding the thermal adhesive yarn and the non-thermal adhesive yarn from two independent yarn feeders, respectively.

In S1, every other stitches (stitches of knitting needles D, H, L) held on the FB are transferred to the BB, and in S2, the reinforcement knitting yarn is fed from a yarn feeder 8 to between the FB and the BB. In S3, the stitches transferred to the BB in S1 are returned to the FB. The reinforcement knitting yarn is sandwiched so as to thread between the outer side and the inner side of the stitches held on the FB by the series of operations. The reinforcement degree of the base section 10 can be increased by reciprocating the yarn feeder 8 and increasing the number of knitting with the reinforcement knitting yarn in S2.

The reinforcement knitting yarn is sandwiched in the stitch row through the procedures similar to S1 to S3 for the stitch row of the base section 10 held on the BB as well (see S4 to S6). Lastly, as shown in S7, the stitch row to become the base section 10 is knitted for one row using the yarn feeder 7, and the reinforcement knitting yarn is prevented from being removed from the base section 10.

[Knitting of Main Body Back Part Region γ]

The knitting of the stitch row following the wale direction of the pickup stitches (edge L2) of c-e and the stitches (edge L1) of e-f of the heel cover portion 3H, and the transferring of the knitted stitch row toward the side of the insert section 4 (left side) to overlap the stitches of c-d are repeated. According to such knitting, the sole cover section 2 is knitted following the edge L1 of the heel cover portion 3H, the body portion 3B is knitted following the edges L2, L3, and the g-h of the main body back part region γ of the body section 3 is joined to the c-d of the insert section 4, as shown in FIG. 1. In this case, at the edge L1, the starting end in the wale direction of the sole cover section 2 is formed in continuation to the terminating end in the wale direction of the heel cover portion 3H, and at the edges L2, L3, the starting end in the wale direction of the body portion 3B is formed following the pickup stitches formed at the end in the knitting width direction of the heel cover portion 3H. That is, at the edges L2, L3, the knitting direction of the heel cover portion 3H and the knitting direction of the body portion 3B are substantially orthogonal, and the heel cover portion 3H and the body portion 3B are in a three-dimensionally connected state.

In the present embodiment, when increasing the number of the stitch rows configuring the main body back part region γ of the body portion 3B, the knitting width of the stitch row is narrowed, and then the knitting width of the stitch row is increased. Thus, as shown in FIG. 1, the portion corresponding to the ankle of the wearer in the insert section 4 curves toward the sole cover section 2 side so as to avoid the ankle (see also g-h in FIG. 2). The curved shape is formed by increasing and decreasing the number of stitches in the knitting width direction of the body portion 3B at the position (position of g-h in FIG. 2) of the foot insertion opening side. Thus, the stitches configuring the body portion 3B are aligned straight from the heel cover portion 3H toward the toe portion.

[Main Body Central Region δ]

A plurality of stitch rows to become the main body central region δ of the body portion 3B is knitted following the wale direction of the stitches of a-d(h)-i. In this case, the knitting width of the stitch row is narrowed at the position of the long dotted line toward the main body front part region ϵ so that the shape of the main body central region δ becomes tapered along the shape of the foot. Furthermore, in the present embodiment, when knitting the main body central region δ, the eyelet hole 60 is formed at the position in the vicinity of the slit 50 (see FIG. 1). The eyelet hole 60 can be formed through a known mesh knitting, miss knitting, and the like.

In the shoe upper 1 of the present embodiment, the base section 10 to be reinforced with the reinforcement knitting yarn is also formed in the main body central region δ. Specifically, the base section 10 is formed across the instep cover section 3 and the sole cover section 2 so as to surround the portion slightly heel side of the root of the toe of the wearer. The reinforcement knitting yarn same as that used to reinforce the heel cover portion 3H is used for the reinforcement knitting yarn for reinforcing the base section 10. In other words, one yarn feeder is provided to be used for the reinforcement in the knitting of the shoe upper 1 of the present embodiment.

Normally, the strength required in the base section 10 of the main body central region δ and the strength required in the heel cover portion 3H (base section 10) of the heel region β are different. The reinforcement degree of the base section 10 of the main body central region δ is made different from the reinforcement degree of the heel cover portion 3H. For example, if three inlay knitting yarns are interwoven with respect to one stitch row (number of knitting=3) when reinforcing the heel cover portion 3H (base section 10), two inlay knitting yarns are interwoven with respect to one stitch row (number of knitting=2) when reinforcing the base section 10 of the main body central region δ. Thus, even if only one yarn feeder feeds the reinforcement knitting yarn, the reinforcement degree of the base sections 10 can be made different by changing the number of knitting with the reinforcement knitting yarn with respect to the base sections 10.

[Knitting of Main Body Front Part Region ϵ]

When knitting the main body front part region ϵ, the portion to become a cut end 51 of the slit 50 (see FIG. 1) is first set up with the C-shaped knitting. Then, the main body front part region ϵ is knitted by carrying out the tubular knitting in continuation to the stitch row at the terminating end in the wale direction of the main body central region δ and the stitch row of the portion to become the cut end 51. In this case, the narrowing stitch is formed at the position on the instep side of the instep cover section 3 and the position of the sole cover section 2 shown with the short dotted line (see also short dotted line in FIG. 1) to reduce the knitting width, and lastly, the distal end k−1 is closed together. As shown in FIG. 1, the shape on the distal end side of the shoe upper 1 can be formed to a shape tapered along the shape of the foot.

After the knitting of the shoe upper 1 is terminated, the entire shoe upper 1 is fitted to a last (foot model) and subjected to thermal treatment to three-dimensionally mold the shoe upper 1.

As described above, the shoe upper 1 of the present embodiment is obtained by integrally knitting the instep cover section 3 and the sole cover section 2 in a seamless manner, and thus excels in productivity. When connecting the outer sole to the shoe upper 1, the shoe upper 1 made from a knitted fabric is already held in a three-dimensional shape, and thus the alignment of the shoe upper 1 and the outer sole is facilitated, and furthermore, since the shoe upper 1 is less likely to lose shape, the connecting task itself is also facilitated.

In the shoe upper 1 of the first embodiment, the base knitting yarn configuring the base section 10 and the reinforcement knitting yarn reinforcing the base section 10 both contain the thermal adhesive yarn. Thus, when the knitted shoe upper 1 is subjected to the thermal treatment, the thermal adhesive yarn contained in the base knitting yarn is melted and the shape and the arrangement of the stitches of the base section 10 formed with the non-thermal adhesive yarn contained in the base knitting yarn are fixed. At the same time, the thermal adhesive yarn contained in the reinforcement knitting yarn is melted, and the shape and the arrangement of the stitches of the base section 10 are reinforced. As a result, the shoe upper 1 of the first embodiment becomes the shoe upper 1 that is less likely to lose shape compared to a conventional shoe upper.

Second Embodiment

In the first embodiment, the knitting is started from the insert section, and the shoe upper is knitted from the heel region β toward the main body front part region ϵ. On the other hand, the insert section may be knitted after knitting the shoe upper from the main body front part region ϵ toward the heel region β. For example, in the case of the shoe upper 1 of the first embodiment that references FIG. 1, the shoe upper 1 may be knitted through a knitting procedure in which the knitting procedure of FIG. 2 is substantially turned upside down.

Third Embodiment

In the first and second embodiments, the shoe upper of a shoelace type including a shoelace has been described, but a shoe upper for a slip-on shoe without a shoelace may be realized. In this case, the insert section 4 is formed to a tubular shape, and the slit 50 extending from the insert section 4 toward the toe is not to be formed when knitting the instep cover section 3.

In addition, the insert section 4 may not be knitted when knitting the shoe upper 1. In this case, after the shoe upper 1 without the insert section 4 is completed, a reinforcement material made of resin and the like is preferably attached, or the insert section 4 knitted separate from the shoe upper 1 is preferably joined, to the edge portion of the foot insertion opening 40.

Fourth Embodiment

In the first embodiment, the base knitting yarn and the reinforcement knitting yarn are independent knitting yarns. On the contrary, the thermal adhesive yarn contained in the base knitting yarn and the thermal adhesive yarn contained in the reinforcement knitting yarn may be the same. For example, a yarn feeder X for feeding the thermal adhesive yarn and a yarn feeder Y for feeding the non-thermal adhesive yarn are prepared, where the plating knitting is carried out using both the yarn feeder X and the yarn feeder Y when forming the base section 10 and only the yarn feeder X is used when reinforcing the base section 10. Alternatively, a yarn feeder Z for feeding the thermal adhesive yarn and the non-thermal adhesive yarn in an aligned state is prepared, and after knitting the base section 10 using the yarn feeder Z, the base section 10 may be reinforced using the same yarn feeder Z. In this case, the base knitting yarn and the reinforcement knitting yarn are the same knitting yarns.

The present invention is not limited to the embodiments described above. For example, the reinforcement knitting yarn may be interwoven in the insert section 4 and the portion corresponding to the toe to reinforce the relevant areas.

DESCRIPTION OF REFERENCE NUMERALS

1 shoe upper
2 sole cover section
3 instep cover section
10 base section
3H heel cover portion
3B body portion
4 insert section
40 foot insertion opening
50 slit
51 cut end
60 eyelet hole
7, 8 yarn feeder

The invention claimed is:

1. A method for knitting a shoe upper including an instep cover section that covers a portion on an instep side of a wearer and a sole cover section that covers a sole of the wearer, wherein the instep cover section and the sole cover section are three-dimensionally knitted in a seamless manner; comprising knitting at least one base section configuring a part of the shoe upper using a base knitting yarn containing a non-thermal adhesive yarn and a thermal adhesive yarn, and interknitting a reinforcement knitting yarn containing a thermal adhesive yarn into stitch rows configuring the base section by carrying out at least one of the following steps:

a) partially changing reinforcement of the base section by changing the number of stitch rows interknitted with the reinforcement knitting yarn, (b) chancing reinforcement of a plurality of base sections in the shoe upper, by making the number of stitch rows interknitted with the reinforcement knitting yarn in some base sections different from the number of stitch rows interknitted with the reinforcement knitting yarn with respect to the other base sections.

2. The method for knitting the shoe upper according to claim 1, wherein the base section, in which the reinforcement knitting yarn is interknitted, is knitted across the instep cover section and the sole cover section.

3. The method for knitting the shoe upper according to claim 1, wherein the reinforcement knitting yarn contains a non-thermal adhesive yarn.

4. The method for knitting the shoe upper according to claim 1, wherein the reinforcement knitting yarn is interknitted in the base section by tuck knitting.

5. The method for knitting the shoe upper according to claim 1, wherein the reinforcement knitting yarn is interknitted in the base section by inlay knitting.

* * * * *